United States Patent [19]

Korte

[11] 4,118,846

[45] Oct. 10, 1978

[54] BURNISHING ATTACHMENT

[75] Inventor: Helmut Gerhard Korte, San Pedro, Calif.

[73] Assignee: Autospin, Inc., Carson, Calif.

[21] Appl. No.: 785,913

[22] Filed: Apr. 8, 1977

Related U.S. Application Data

[63] Continuation of Ser. No. 639,902, Dec. 11, 1975, abandoned.

[51] Int. Cl.[2] ..... B24B 39/00

[52] U.S. Cl. ..... 29/90 R; 72/81

[58] Field of Search ..... 29/90; 72/68, 80–83, 72/206, 207

[56] References Cited

U.S. PATENT DOCUMENTS

| | | | |
|---|---|---|---|
| 2,977,669 | 4/1961 | Chambers | 29/90 |
| 3,104,640 | 9/1963 | Sassen et al. | 72/81 X |
| 3,282,078 | 11/1966 | Kaesemeyer | 72/82 |
| 3,748,883 | 7/1973 | Ashizawa et al. | 72/81 |

FOREIGN PATENT DOCUMENTS

| | | | |
|---|---|---|---|
| 810,590 | 8/1951 | Fed. Rep. of Germany | 29/90 |

*Primary Examiner*—Leonidas Vlachos
*Attorney, Agent, or Firm*—Flam & Flam

[57] ABSTRACT

A burnishing attachment includes a carriage mounted for traversing movement in a path that extends along the workpiece. A non-rotary burnishing tool is mounted on said carriage for movement perpendicular to the carriage path. The tool is urged toward the rotating workpiece with a force that is a preset function of the position of the tool along the workpiece whereby the burnishing force adjusts to the appropriate amount. The tool is pivoted so that its surface maintains a normal relationship to the workpiece notwithstanding a change in angularity of the workpiece surface and the tool mounting.

9 Claims, 9 Drawing Figures

BURNISHING ATTACHMENT

This is a continuation of application Ser. No. 639,902, filed 12/11/75 and now abandoned.

FIELD OF INVENTION

This invention relates to metal finishing but particularly to burnishing or planishing.

DISCUSSION OF THE PRIOR ART

Burnishing is often the required final step in manufacturing metal objects. Burnishing eliminates surface irregularities left by machine operations. For example spinning rollers leave generally circular ridges about the work. To remove such ridges, a smoothfaced tool is placed in engagement with the rotating work. In the past this has commonly been done by hand with a long tool support being tucked under the worker's armpit in order to resist the torque imposed on the burnishing tool.

This hand operation is time consuming and costly. The primary object of this invention is to provide a burnishing machine or machine attachment that effeciently performs the necessary burnishing operations.

U.S. Pat. No. 2,977,669 to Chambers discloses a burnishing attachment or machine that is intended to eliminate the ridges formed on aircraft wheels in order to prevent localized stresses. Chambers discloses a traverse mechanism and a rotary burnishing tool head that follows the profile of the finished product. I have found, however, that acceptable burnishing cannot always be accomplished with the aid of a rotary tool because the rotary burnishing tool itself produces small circular ridges. Another object of this invention is to provide a burnishing attachment that properly feeds a non-rotary burnishing tool along the workpiece surface. The contact pressure, however, must be carefully controlled or regulated to ensure that the surface is smoothed but not excessively worked. Chambers controls the contact pressure by interposing a pneumatic cylinder between the roll burnishing tool and its support. The pneumatic piston urges the burnishing tool into engagement with the work with a pressure that is easily regulated. While Chambers suggests that the force of pressure be uniform in order to obtain a satisfactory result, I find that the contact pressure between the burnishing tool and the work must be appreciably changed depending upon whether the surface engaged by the burnishing tool is of slight or substantial curvature and whether or not it extends generally parallel to or at a steep angle with respect to the work axis. Accordingly, a primary object of this invention is to provide a burnishing machine or burnishing attachment whereby the contact pressure between the burnishing tool and the work is programmable or presettable as a function of burnishing tool position along the work.

Another object of this invention is to provide a burnishing tool that while non-rotary is nevertheless pivoted on a skew axis so that it can follow the surface of the work as it changes its angularity relative to the work axis. Still another object of this invention is to provide a novel burnishing tool that is capable of following even abrupt surface changes in the work in a smooth and controlled manner.

If a burnishing attachment is provided for an existing spinning tool then it might be expected that the total output of the machine would be reduced because an extra burnishing step is required at the conclusion of the spinning operation. An object of the present invention is to provide a burnishing attachment which does not materially affect work cycle time of the machine. If burnishing is to be accomplished while the work remains in the spinning machine, then there is an area of the work engaged by the work clamp that precludes access of the burnishing tool. An object of this invention is to make it possible to burnish the entire work from its distal edge to the very apex beneath the portion normally clamped by the machine.

SUMMARY OF INVENTION

The foregoing objects are accomplished by an attachment having cooperating features. A pivoted, but non-rotary burnishing tool reacts to assume a normal or perpendicular relationship to the workpiece while the thrust is controlled. The thrust is determined by the pressure of a pneumatic or hydraulic cylinder that urges the pivoted tool into workpiece engagement. The pressure to the cylinder is determined by the setting of a pressure regulator, the regulator having a feeler or follower that traverses with the tool, the feeler or follower engaging a track the contour of which is determined by a series of adjustable stops or holders.

A special polygonal tool allows the tool to step to adjacent workpiece surfaces having markedly different angularities.

By locating the attachment alongside the workpiece in spaced relationship to the spinning roller, the burnishing can progress substantially simultaneously with the final spinning pass.

By utilizing the holding power of the burnishing tool itself, the rotating clamping spindle of the spinning lathe may be retracted as the burnishing tool approaches the proximal end of the workpiece. Complete burnishing is accomplished.

BRIEF DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Figure 1:
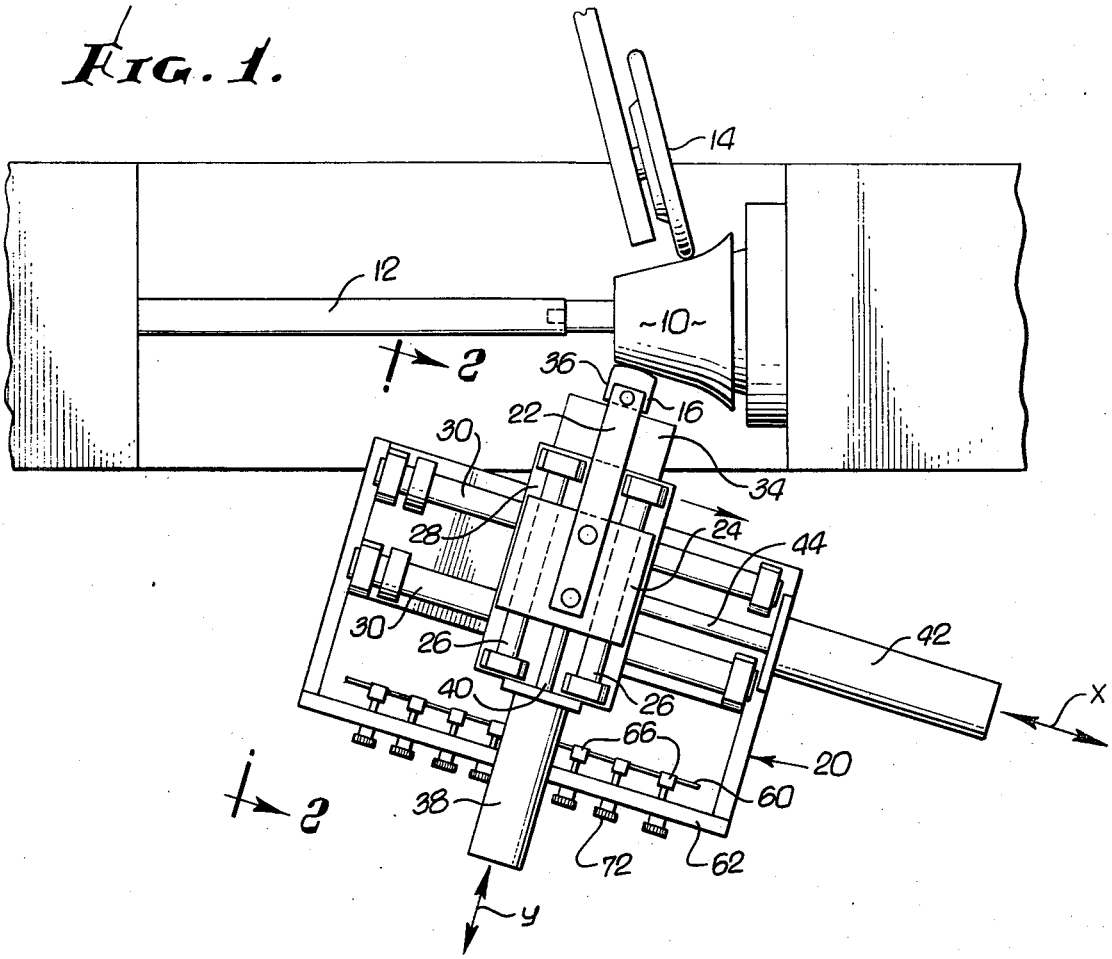
FIG. 1 is a fragmentary plan view of a spinning lathe with the novel burnishing attachment.

In FIG. 1 there is illustrated a horizontal spinning lathe in the process of completing a piece of work 10. The workpiece is clamped to a spinning chuck by the aid of a retractable long travel tailstock spindle 12. A spinning roller 14 is guided for one or a series of successive passes along the work under the control of a conventional template device (not shown). In the present instance the spinning roller 14 is in its final pass along the workpiece. Following closely behind the spinning roller 14 is a burnishing tool 16 located on the opposite side of the lathe. A control device 15 coordinates the traverse of the tools 14 and 16. Moments following the final spinning roller pass, the burnishing itself is completed. No material time is added to the work cycle. A finished product is taken from the machine.

The burnishing tool 16 is mounted upon a frame or table 20 for movement in orthogonal directions indicated by the double headed arrows *x* and *y*. The *x* direction generally parallels the workpiece profile. The burnishing tool 16 is mounted at the projecting end of a supporting rod 22 in turn fastened to the top of a cross head 24 (see also FIG. 2). The cross head is guided for rectilinear movement in the *y* direction by the aid of a pair of guide rods 26 mounted on top of a carriage 28. The carriage 28 in turn is guided for movement in the *x* direction by the aid of a pair of guide rods 30 fastened between end frame elements of the table 20. The table 20 in turn is mounted upon a pad 32 secured to a bracket 34 in such manner as to permit adjustment of the angularity between the traverse direction *x* and the lathe axis. The tool 16 is supported so as to be at the level of the lathe axis.

The burnishing tool 16 is in the form of a hardened lug having a simple convex surface 36. The tool is pivotally mounted in a slot at the projecting end of a support bar 22, the other end of which is attached on the top of the cross head 24. The cross head is urged in the *y* direction toward the work by the aid of a pneumatic motor 38 (FIG. 2) attached to the end of the carriage 24 opposite the tool 16. A piston rod 40 is aligned with the tool 16 and connects to the cross head.

Figure 3:
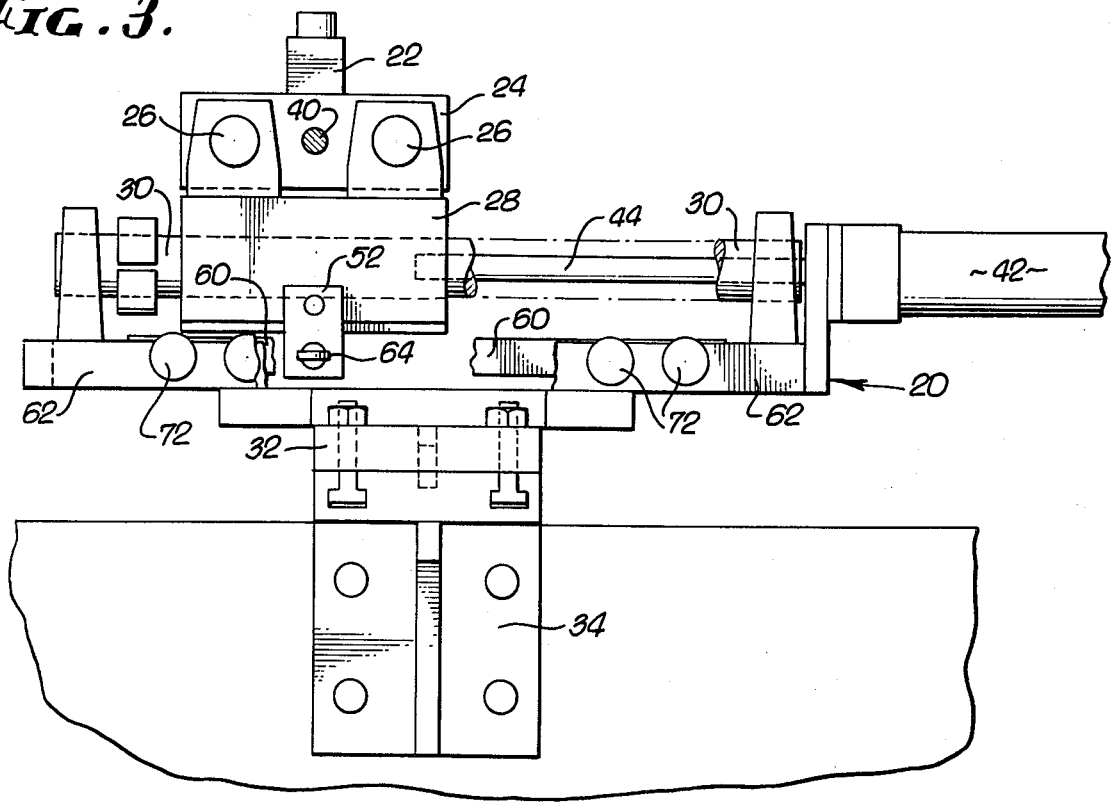
FIG. 3 is a fragmentary sectional view taken along the offset plane 3—3 of FIG. 2.
Figure 4:
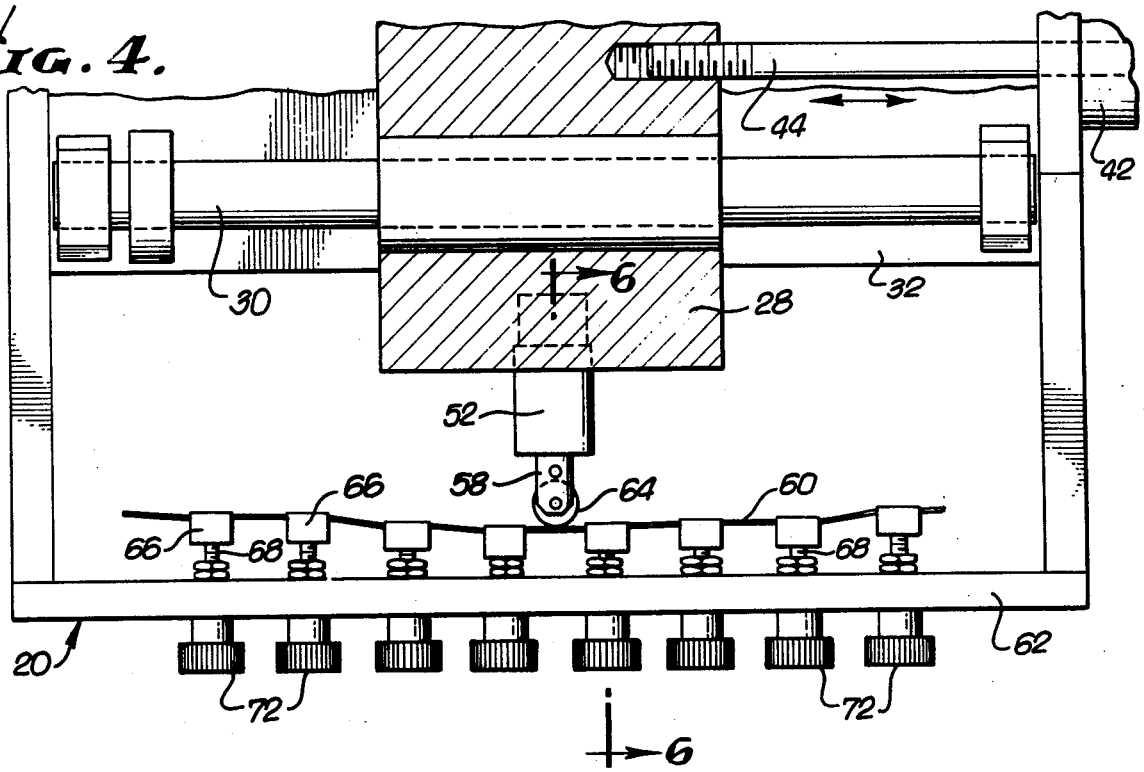
FIG. 4 is a fragmentary sectional view taken through the axis of the guide rods for the traversing burnishing tool carriage.

The force exerted by the piston rod 40 and hence by the tool on the workpiece is directly determined by the pneumatic pressure supplied to the motor 38. This pressure is controlled in a manner hereinafter to be described so that the burnishing force is increased or decreased in accordance with the changing curvature and angularity of the workpiece. The carriage 28 is caused to traverse in this instance by a hydraulic motor 42. The hydraulic motor 42 is attached to one end of the table 20. The motor 42 has a piston rod 44 (FIGS. 3 and 4) that is attached centrally at one side of the carriage 28. Suitable controls cause the motor 42 to start, stop and reverse. In one mode, the motor is controlled relative to the spinning roller 14 so that the burnishing tool closely follows.

Figure 6:
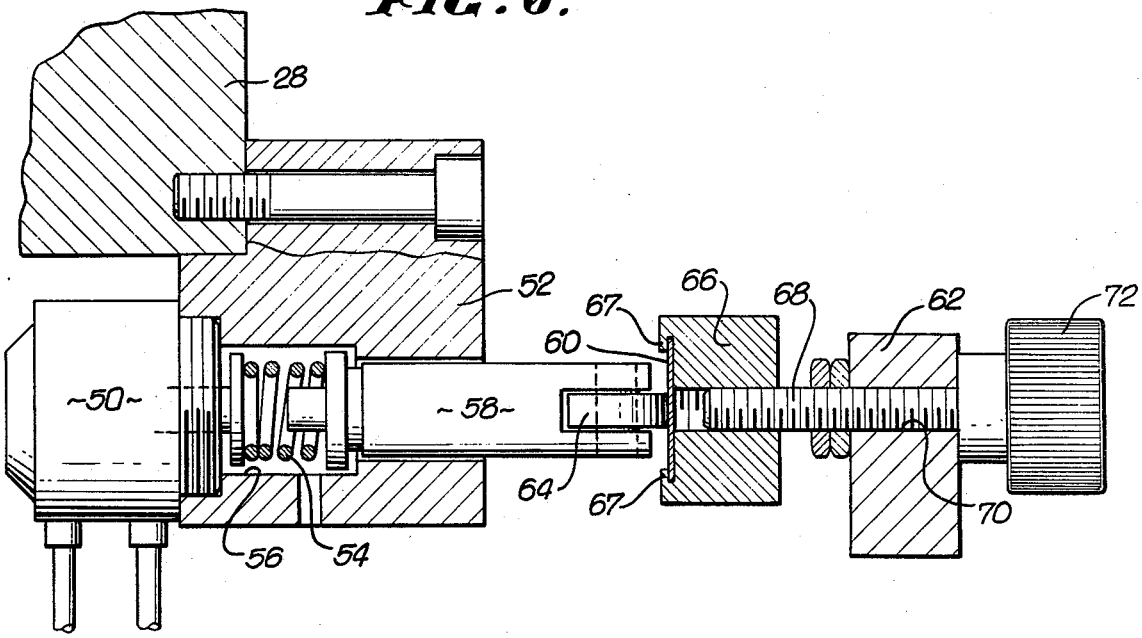
FIG. 6 is an enlarged fragmentary view taken along the plane corresponding to line 6—6 of FIG. 4.
Figure 2:
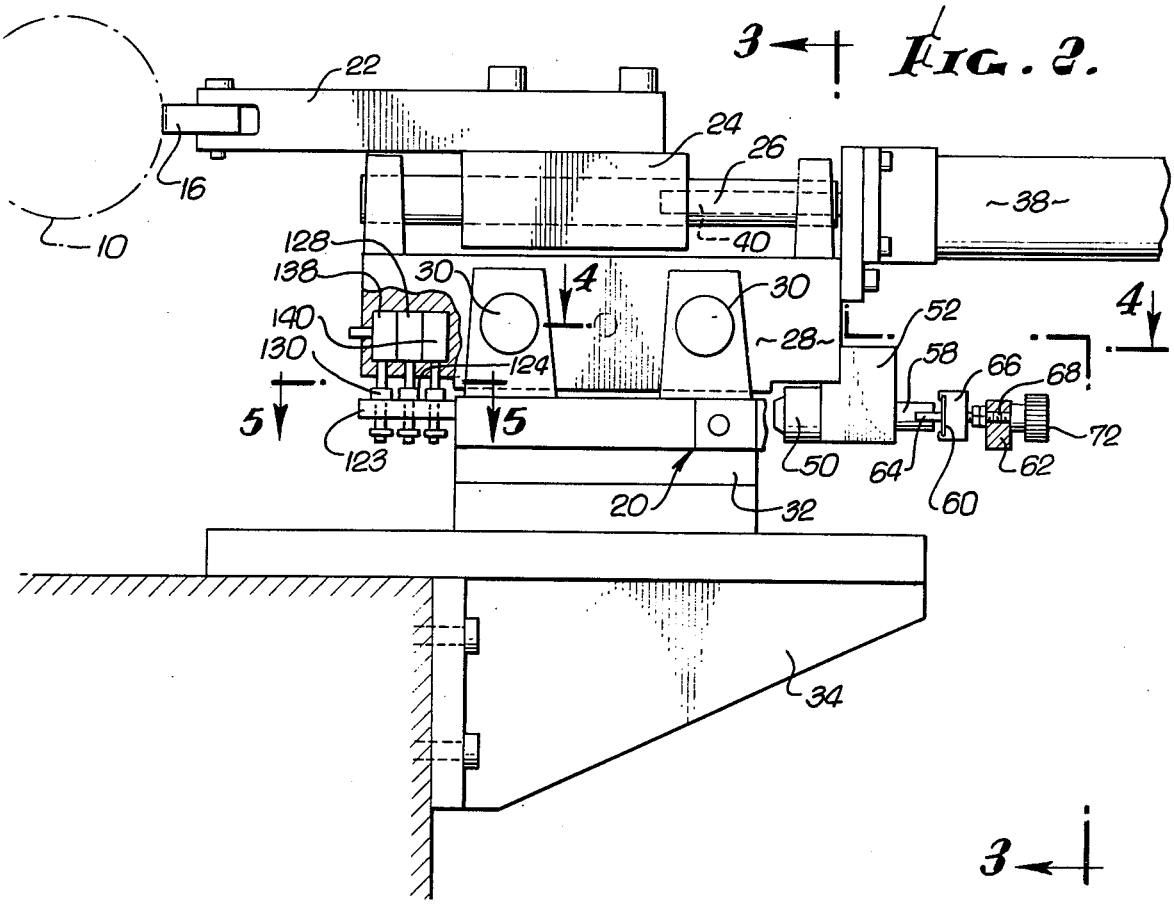
FIG. 2 is an enlarged fragmentary end elevational view of the burnishing attachment taken in a direction of the arrows 2—2 of FIG. 1, a portion of the apparatus being broken away and shown in section.

The pneumatic pressure to the cross-head motor 38 is controlled by a pressure regulator 50 (FIG. 6) mounted on a block 52 attached to the bottom corner of the carriage 28 just beneath the pneumatic motor 38. The mounting block is located just inside one of the frame elements of the table 20 as shown in FIG. 2 so that it moves along the table frame element as the carriage traverses. The regulator is attached at the inside of the block 52 so as to be located beneath the carriage 28. The regulator 50 is of a known type having an inlet chamber and an outlet chamber, communication between the chambers being open when the pressure in the outlet chamber decreases below a value set by a spring 54. By changing the spring tension, the regulated output pressure is correspondingly adjusted. The spring 54 is accommodated in a through stepped bore 56 in the block 52. One end engages a part of the regulator and its other end engages a follower rod 58. By moving the follower rod 58 inwardly and allowing it to move outwardly, the spring tension is correspondingly increased or decreased and the regulated pressure is correspondingly adjusted.

The position of the follower rod 58 is determined by a spring steel strip flexed to a track 60. The track is held just inside the table rail or frame element 62 along which the follower rod 58 travels. The track is engaged by a roller 64 mounted at the projecting end of the follower rod 58. The spring 54 urges the rod 58 outwardly and into engagement with the track 60. The track 60 is supported by a series of individual holders 66 each mounted on the frame element 62. Each holder has a flat surface against which the track is held by the aid of top and bottom flanges 67.

Each holder can be moved inwardly or outwardly in order to determine the contour of the track 60. For this purpose a lead screw 68 is provided that extends through a clearance aperture 70 in the rail 62. The outer end of the screw 68 carries an adjustment knob 72. By rotating the knobs, the holders 66 are positioned. By careful adjustment, the pressure at each position of the carriage 26 can be determined. Optionally, a template can be installed at the inside of the table rail 62 to provide a preset functional relationship matched to a particular piece of work.

As the angularity of the work profile changes relative to the angularity of the traverse direction *x*, the burnishing tool 16 pivots about its pin. The same central line of the tool contacts the work at all times, the reaction force on the tool passing through the pivot axis. The tool is thus positioned normal to the work for proper burnishing action. This positioning results automatically because the radius of curvature of the burnishing tool surface is greater than its distance from the pivot axis. Thus if the tool surface is away from a normal relationship relative to the workpiece surface, a torque will be imposed upon the tool tending to rotate it back to center. The distance between the pivot axis and the tool surface is sized relative to the workpiece. The sharper the curvatures, the smaller the tool.

DESCRIPTION OF SPECIAL TOOL

Figure 7:
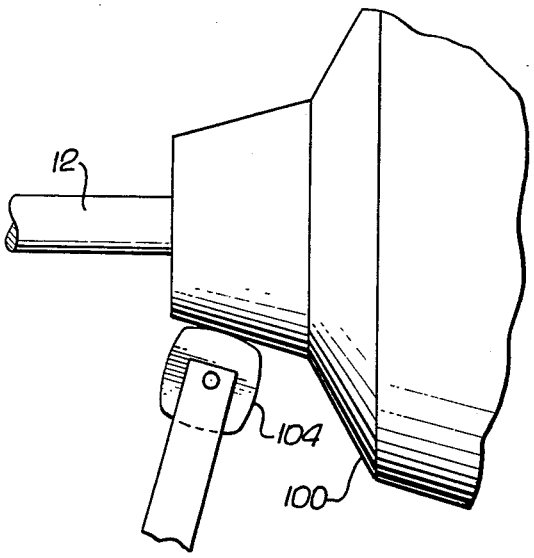
FIGS. 7 and 8 are diagrammatic views illustrating how an alternate burnishing tool is capable of stepping around a workpiece having abrupt changes in surface contour.
Figure 8:
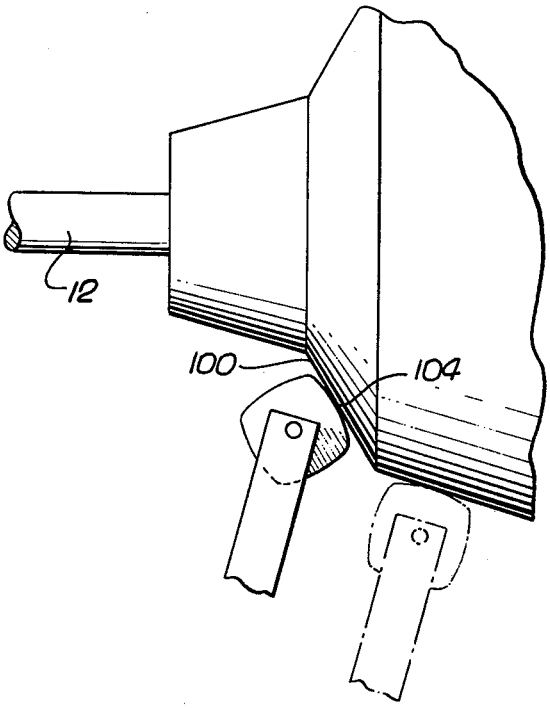

However, it is possible to burnish notwithstanding abrupt changes in the curvature of the workpiece by using a tool of special configuration. Thus in FIGS. 7 and 8 there is illustrated a workpiece having two surfaces joined by an abrupt shoulder 100. The tool is in the form of a polygon, in this instance a square, with its surfaces just slightly convex. When the tool reaches an edge, as for example at the bottom of the surface or shoulder 100, it steps or rotates so that the adjacent surface 104 of the tool becomes operative. When the tool reaches the outer edge of the shoulder, the tool snaps around just as soon as the pivot axis has moved far enough to allow the reaction to rotate the tool to the next surface.

DESCRIPTION OF APEX FINISHING MODE

Figure 9:
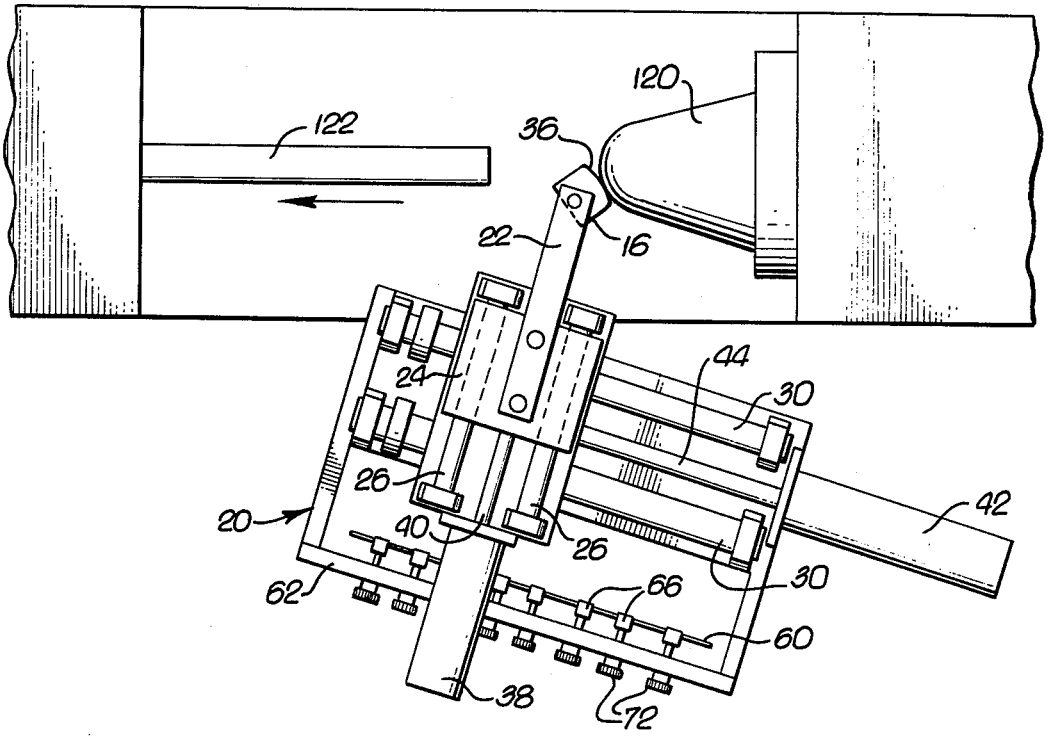
FIG. 9 is a diagrammatic view illustrating how the mechanism can be used to achieve burnishing at the apex of the spun work.

Some workpieces require burnishing to their very apex. Such a workpiece 120 is illustrated in FIG. 9. It may be a reflector housing or any one of a number of bowl-like products having an apex that is not to be a flat base. In order to burnish such an item, the direction of traverse is such that the tool first engages the distal end of the workpiece, then traverses in the $x$ direction toward the apex of the workpiece. Just before the burnishing tool reaches the region of the tailstock spindle 122, the tailstock spindle retracts while the lathe parts continue to rotate. A retracting means 123 is provided for this purpose. At this point, the workpiece is clamped by the pressure of the burnishing tool without dependence upon the tailstock spindle.

Retraction of the spindle at the appropriate time can be accomplished automatically by the aid of control mechanisms.

DESCRIPTION OF TRAVERSE CONTROLS

Figure 5:
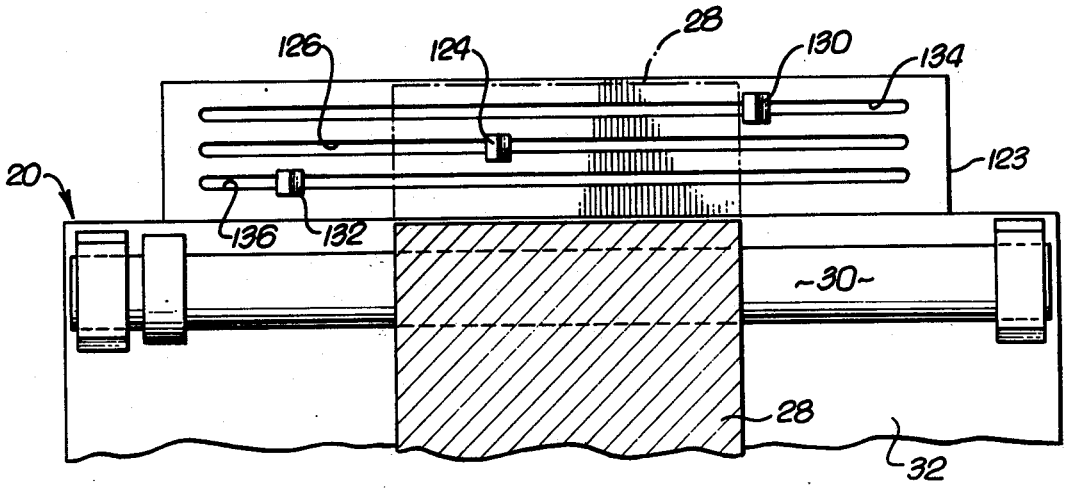
FIG. 5 is a fragmentary sectional view taken along the plane corresponding to line 5—5 of FIG. 2 and illustrating the limit controls and position sensors.

A flange 123 (FIG. 5) attached to the inside rail of the table 20 has a cam operator 124 that can be positioned at a place along the path of the carriage corresponding to desired tailstock spindle retraction. For this purpose, the flange has an elongate mounting groove 126 for the cam operator. The cam operator 124 engages a miniature switch 128 (FIG. 2) mounted on the underside of the carriage 28. The switch 128 causes operation of the retracting means 123. Two other cam operators 130 and 132 (FIG. 5) are mounted at selected places along their grooves 134 and 136 to engage miniature switches 138 and 140 (FIG. 2). These switches determine traverse limits of the hydraulic motor 42.

DESCRIPTION OF FOLLOW MODE

Burnishing is accomplished effectively and without materially increasing the work cycle time of the spinning lathe. A blank is inserted into the lathe and removed as a finished piece requiring no additional operations. Burnishing pressure is programmed for a unique burnishing tool that follows just after the final spinning pass.

Intending to claim all novel, useful and unobvious features shown or described, I make the following claims:

1. In apparatus for burnishing a workpiece turning in a lathe:

(a) a carriage;
(b) means mounting the carriage for traversing movement in a path extending along the said workpiece;
(c) motor means for moving said carriage along its said path;
(d) a burnishing tool;
(e) means mounting said burnishing tool on said carriage for movement transverse to said path;
(f) motor means for urging said burnishing tool into engagement with said workpiece; and
(g) means for determining the force exerted by said motor means as a function of traverse position whereby the burnishing force varies to conform to the surface characteristics of said workpiece.

2. The combination as set forth in claim 1 in which said motor means comprises a pneumatic motor, said force determining means including a pressure regulator connected to said pneumatic motor to control the force exerted thereby, said pressure regulator having a control element operable to determine the setting of said pressure regulator, and means tracking with said carriage for adjusting said control element.

3. The combination as set forth in claim 1 in which said motor means is a pneumatic piston and cylinder mounted on said carriage, said force determining means including a pressure regulator also mounted on said carriage and connected to said pneumatic cylinder to control the force exerted by its piston, said pressure regulator having an adjustable stress spring, the stress of which determines the setting of said regulator, and a contoured track extending along the said traverse path and engageable with the spring to adjust the stress therein and thereby said force in accordance with traverse position.

4. The combination as set forth in claim 3 in which said track comprises a flexible strip, said combination also including a series of holders for said strip and each adjustable to determine the contour thereof.

5. In apparatus for burnishing a workpiece:

(a) a lathe having a headstock and a tailstock;
(b) a support for a burnishing attachment;
(c) a carriage;
(d) means mounting the carriage on the support for traversing movement in a path;
(e) adjustable means for determining the alignment of said path with said lathe axis so that said path approximately parallels the profile of the workpiece;
(f) motor means for moving said carriage along its said path;
(g) a non-rotary burnishing tool;
(h) means pivotally mounting said burnishing tool on an axis substantially skew to the axis of said lathe;
(i) means mounting said burnishing tool on said carriage for movement transverse to said path; and
(j) pneumatic motor means for urging said burnishing tool into engagement with said workpiece as said carriage traverses in its said path.

6. In apparatus for burnishing a workpiece:

(a) a table having means for attachment to the side of a lathe, said table having guides;
(b) a tool carriage slidably mounted by said guides for traversing movement in a rectilinear path;
(c) a motor mounted on said table for moving said carriage between limits in its said path;
(d) said carriage having guides extending transversely of said path;
(e) a cross head mounted on said carriage guides for rectilinear movement transverse to said carriage path;
(f) a burnishing tool mounted on said cross head and positioned to engage said workpiece;
(g) a hydraulic or pneumatic motor mounted on said carriage for urging said cross head in a direction toward said workpiece with a force corresponding to the supply pressure to said motor;
(h) a pressure regulator carried on said carriage, said regulator having an output connected to said hydraulic or pneumatic motor, said regulator also having a spring the stress of which determines the pressure of said output, a follower member engaging the spring and movable to change the stress of said spring; and (i) means forming a track along said table and engageable with said follower as said pressure regulator traverses with said carriage, the configuration of said track determining the functional relationship between burnishing tool force.

7. The combination as set forth in claim 6 in which said track comprises a flexible strip and a series of holders spaced along the strip, there being screw adjustable means for individually changing the position of the holders.

8. In apparatus for burnishing in a lathe:

(a) a carriage;

(b) means mounting the carriage for traversing movement in a path extending along the turning axis of said workpiece;

(c) motor means for moving said carriage along its said path;

(d) a cross head;

(e) means mounting the cross head on the carriage for movement transverse to said path towards and away from said turning axis;

(f) a non-rotary burnishing tool;

(g) means pivotally mounting said burnishing tool on said cross head on an axis substantially skew to the axis of the lathe;

(h) said tool having a burnishing surface located between the skew axis and said workpiece and generated about the pivot axis of the tool on a radius of curvature larger than the distance of said surface from said pivot axis whereby said tool stabilizes itself in a normal position to said workpiece; and (i) means yieldingly urging said cross head toward said workpiece axis to cause said tool to engage said workpiece.

9. In apparatus for burnishing a workpiece turning in a lathe:

(a) a carriage;

(b) means mounting the carriage for traversing movement in a path extending along said workpiece;

(c) motor means for moving said carriage along its said path;

(d) a cross head;

(e) means mounting the cross head on the carriage for movement transverse to said path;

(f) a burnishing tool;

(g) means pivotally mounting said burnishing tool on said cross head on an axis substantially skew to the axis of the lathe;

(h) said tool having a surface generated about the pivot axis of the tool on a radious of curvature larger than the distance of said surface from said pivot axis whereby said tool stabilizes itself in a normal position to said workpiece;

(i) means for urging said cross head toward said workpiece;

(j) said tool having a series of nearly flat surfaces each with a radius of curvature larger than the distance of the surface from the pivot axis, said surfaces adjoining each other at relative sharp corners whereby said tool automatically steps about sharply angular parts of the work.

* * * * *